US007016631B2

(12) United States Patent
Schlafer et al.

(10) Patent No.: US 7,016,631 B2
(45) Date of Patent: Mar. 21, 2006

(54) METAL AND CERAMIC BLEND DONOR ROLL COATINGS

(75) Inventors: Michelle L. Schlafer, Fairport, NY (US); Joy L. Longhenry, Webster, NY (US)

(73) Assignee: Xerox Corporation, Stamford, CT (US)

( * ) Notice: Subject to any disclaimer, the term of this patent is extended or adjusted under 35 U.S.C. 154(b) by 208 days.

(21) Appl. No.: 10/714,164

(22) Filed: Nov. 13, 2003

(65) Prior Publication Data

US 2005/0105935 A1 May 19, 2005

(51) Int. Cl.
*G03G 15/08* (2006.01)

(52) U.S. Cl. ..... 399/266; 399/286

(58) Field of Classification Search ..... 399/266, 399/279, 286

See application file for complete search history.

(56) References Cited

U.S. PATENT DOCUMENTS

| | | | | |
|---|---|---|---|---|
| 5,473,418 | A | 12/1995 | Kazakos et al. | |
| 5,600,414 | A | 2/1997 | Hyllberg | 399/176 |
| 5,697,029 | A * | 12/1997 | Saitoh et al. | 399/286 |
| 6,212,349 | B1 * | 4/2001 | Labombard | 399/286 |
| 6,226,483 | B1 | 5/2001 | Kazakos et al. | 399/266 |
| 6,327,452 | B1 * | 12/2001 | Jaskowiak et al. | 399/286 |
| 6,512,910 | B1 * | 1/2003 | Aoki et al. | 399/286 |
| 6,560,432 | B1 | 5/2003 | Longhenry et al. | 399/286 |
| 6,733,891 | B1 * | 5/2004 | Blair et al. | 399/286 |

* cited by examiner

*Primary Examiner*—William J. Royer
(74) *Attorney, Agent, or Firm*—Annette L. Bade

(57) ABSTRACT

A donor member useful in ionographic or electrophotographic apparatuses and useful in hybrid scavengeless and hybrid jumping development units, the donor member having a substrate and an outer coating of a blend including metal and ceramic.

19 Claims, 3 Drawing Sheets

METAL AND CERAMIC BLEND DONOR ROLL COATINGS

BACKGROUND

The present invention relates to coatings for members of ionographic or electrophotographic machines, including digital, image on image, imaging, copying, and printing apparatuses and machines. In embodiments, the present invention is directed to coatings for donor members. In embodiments, the invention is directed to coatings for donor members including donor rollers and the like, and electrodes closely spaced from a donor member to form a toner powder cloud in a development zone to develop a latent image. The present invention is directed, in embodiments, to suitable conductive and semiconductive overcoatings, especially for donor member or transport members like scavengeless or hybrid scavengeless development systems. In embodiments, the coatings include a blend of metal and ceramic.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed. Two component and single component developer materials are commonly used for development. The following discusses the development process. Toner particles are attracted to the latent image forming a toner powder image on the photoconductive surface. The toner image is subsequently transferred to a copy sheet. Finally, the toner powder image is heated to permanently fuse it to the copy sheet in image configuration.

One type of development system is a single component development system such as a scavengeless development system that uses a donor roll for transporting charged toner (single component developer) to the development zone. At least one, and preferably a plurality of electrode members, are closely spaced to the donor member in the development zone. An AC voltage is applied to the electrode members forming a toner cloud in the development zone. The electrostatic fields generated by the latent image attract toner from the toner cloud to develop the latent image.

Another type of development system is a two component development system such as a hybrid scavengeless development system which employs a magnetic brush developer member for transporting carrier having toner (two component developer) adhering triboelectrically thereto. A donor member is used in this configuration also to transport charged toner to the development zone. The donor member and magnetic member are electrically biased relative to one another. Toner is attracted to the donor member from the magnetic member. The electrically biased electrode members detach the toner from the donor member forming a toner powder cloud in the development zone, and the latent image attracts the toner particles thereto. In this way, the latent image recorded on the photoconductive member is developed with toner particles.

Coatings for donor members are known and may contain a dispersion of conductive particles in a dielectric binder. The desired volume resistivity is achieved by controlling the loading of the conductive material. However, very small changes in the loading of conductive materials at or near the percolation threshold can cause dramatic changes in resistivity. Furthermore, changes in the particle size and shape of such materials can cause wide variations in the resistivity at constant weight loading. If the resistivity is too low, electrical breakdown of the coating can occur when a voltage is applied to an electrode or material in contact with the coating. Also, resistive heating can cause the formation of holes in the coating. When the resistivity is too high, charge accumulation on the surface of the overcoating can create a voltage which changes the electrostatic forces acting on the toner. The problem of the sensitivity of the resistivity to the loading of conductive materials in an insulative dielectric binder is avoided, or minimized with the coatings of the present invention.

Currently, ceramic materials are used for donor members such as donor members used in hybrid scavengeless development apparatuses and hybrid jumping development (HJD). Several problems may be associated with the use of ceramic materials including non-uniform thickness, non-uniform run-out, pinhole defects, and rough surface finish. These problems can result in print defects. The problems are not easily overcome because they may be related to the deformation of substrate during high temperature thermal spray coating of ceramic materials. Grinding the ceramic coatings is needed to provide the desired surface finish.

However, with the coatings of the present invention, the above problems with use of ceramic materials are reduced or eliminated.

U.S. Pat. No. 5,600,414 discloses a charging roller with blended ceramic layer. The ceramic layer includes plasma spraying of a blend of insulating ceramic material and a semiconductive ceramic material in a specified ratio. The desired blend is alumina and titania.

U.S. Pat. No. 6,560,432 B1 discloses a donor roll having a ceramic outer layer coating. The coating consists of particles containing a ratio of pure alumina and pure titania held together with an organic binder.

There exists a need for a donor member coating which provides conductivity or resistivity within a desired range, minimizes residue voltage, is relatively uniform and virtually free from defects and pinholes, provides good wear resistance for up to several million copies and/or prints, for example 10 million copies or prints, provides consistent performance with variable temperature and humidity, is low in manufacturing cost, and is environmentally acceptable. In addition, there exists a need for wear resistant, electrically tunable coatings for hybrid scavengeless and hybrid jumping development.

SUMMARY

Embodiments of the present invention include: a donor member comprising a substrate and thereover a coating comprising ceramic and metal.

Embodiments further include: an apparatus for developing a latent image recorded on a surface, comprising: a) wire supports; b) a donor member spaced from the surface and being adapted to transport toner to a region opposed from the surface, wherein said donor member comprises a substrate and thereover a coating comprising ceramic and metal; and c) an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image.

Moreover, embodiments include: an image forming apparatus for forming images on a recording medium comprising a) a charge-retentive surface to receive an electrostatic latent image thereon; b) a development component to apply toner to said charge-retentive surface to develop said electrostatic latent image to form a developed image on said charge retentive surface, said development component comprising a donor member comprising a substrate and thereover a coating comprising ceramic and metal; and c) a transfer component to transfer the developed image from said charge retentive surface to a copy substrate.

BRIEF DESCRIPTION OF THE DRAWINGS

For a better understanding of the present invention, reference may be had to the accompanying figures.

DETAILED DESCRIPTION

The present invention relates to coatings for donor members in development units for electrostatographic, including digital, image on image, imaging and printing apparatuses, and especially for hybrid scavengeless development and hybrid jumping development units.

Figure 1:
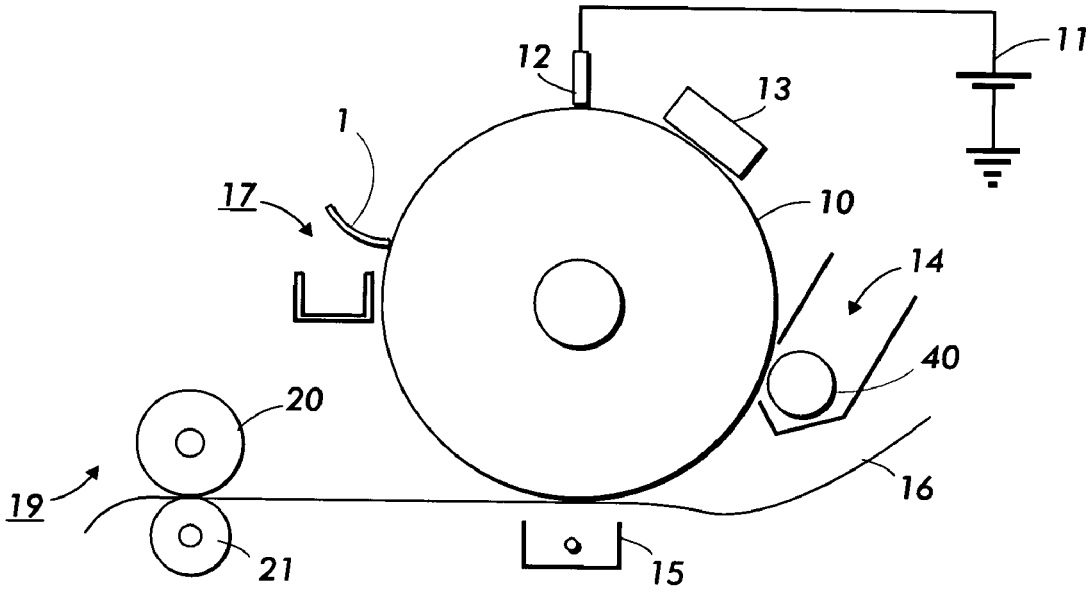
FIG. 1 is a schematic illustration of an image apparatus in accordance with the present invention.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor 10 is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Shown in FIG. 1 is donor roller 40. Development can be affected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to fusing station 19, depicted in FIG. 1 as fuser roll 20 and pressure roll 21 (although any other fusing components such as fuser belt in contact with a pressure roll, fuser roll in contact with pressure belt, and the like, are suitable for use with the present apparatus), wherein the developed image is fused to copy sheet 16 by passing copy sheet 16 between the fusing and pressure members, thereby forming a permanent image. Alternatively, transfer and fusing can be effected by a transfix application.

Photoreceptor 10, subsequent to transfer, advances to cleaning station 17, wherein any toner left on photoreceptor 10 is cleaned therefrom by use of a blade 1 (as shown in FIG. 1), brush, or other cleaning apparatus.

Figure 2:
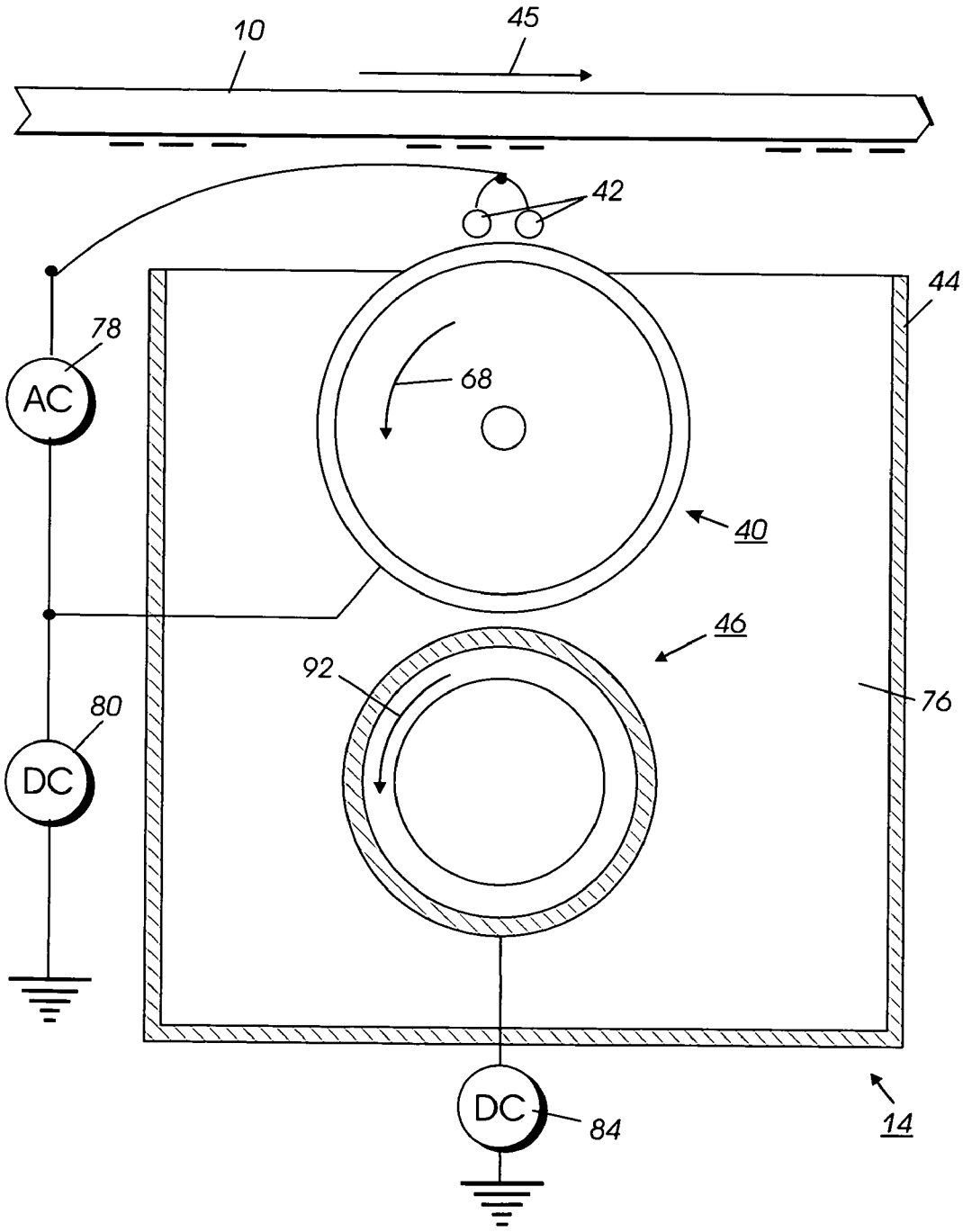
FIG. 2 is a schematic illustration of an embodiment of a development apparatus useful in an electrophotographic printing machine.

Referring now to FIG. 2, in an embodiment of the invention, developer unit 14 develops the latent image recorded on the photoconductive surface 10. Preferably, developer unit 14 includes donor roller 40 and electrode member or members 42. Electrode members 42 are electrically biased relative to donor roll 40 to detach toner therefrom so as to form a toner powder cloud in the gap between the donor roll 40 and photoconductive surface 10. The latent image attracts toner particles from the toner powder cloud forming a toner powder image thereon. Donor roller 40 is mounted, at least partially, in the chamber 76 of developer housing 44. The chamber 76 in developer housing 44 stores a supply of developer material which is a two component developer material of at least carrier granules having toner particles adhering triboelectrically thereto. A magnetic roller 46 disposed interior of the chamber 76 of housing 44 conveys the developer material to the donor roller 40. The magnetic roller 46 is electrically biased relative to the donor roller 40 so that the toner particles are attracted from the magnetic roller 46 to the donor roller 40.

The donor roller 40 can be rotated in either the 'with' or 'against' direction relative to the direction of motion of photoreceptor 10. In FIG. 2, donor roller 40 is shown rotating in the direction of arrow 68. Similarly, the magnetic roller 46 can be rotated in either the 'with' or 'against' direction relative to the direction of motion of photoreceptor belt 10. In FIG. 2, magnetic roller 46 is shown rotating in the direction of arrow 92. Photoreceptor 10 moves in the direction of arrow 45.

A pair of electrode members 42 are shown extending in a direction substantially parallel to the longitudinal axis of the donor roller 40. The electrode members 42 are made from one or more thin (i.e., 50 to 100 $\mu$m in diameter) stainless steel or tungsten electrode members 42 which are closely spaced from donor roller 40. The distance between the electrode members and the donor roller 40 is from about 5 to about 35 $\mu$m, or about 10 to about 25 $\mu$m or the thickness of the toner layer on the donor roll. The electrode members 42 are self-spaced from the donor roller 40 by the thickness of the toner on the donor roller 40.

As illustrated in FIG. 2, an alternating electrical bias is applied to the electrode members 42 by an AC voltage source 78. The applied AC establishes an alternating electrostatic field between the electrode members 42 and the donor roller 40 is effective in detaching toner from the donor roller 40 and forming a toner cloud about the electrode members 42, the height of the cloud being such as not to be substantially in contact with the photoreceptor 10. The magnitude of the AC voltage is relatively low and is in the order of 200 to 500 volts peak at a frequency ranging from about 9 kHz to about 15 kHz. A DC bias supply 80 which applies approximately 300 volts to donor roller 40 establishes an electrostatic field between photoconductive member 10 and donor roller 40 for attracting the detached toner particles from the cloud surrounding the electrode members 42 to the latent image recorded on the photoconductive member. At a spacing ranging from about 10 μm to about 40 μm between the electrode members 42 and donor roller 40, an applied voltage of 200 to 500 volts produces a relatively large electrostatic field without risk of air breakdown. A DC bias supply 84 which applies approximately 100 volts to magnetic roller 46 establishes an electrostatic field between magnetic roller 46 and donor roller 40 so that an electrostatic field is established between the donor roller 40 and the magnetic roller 46 which causes toner particles to be attracted from.

In an alternative embodiment of the present invention, one component developer material consisting of toner without carrier may be used. In this configuration, the magnetic roller 46 is not present in the developer housing 44. This embodiment is described in more detail in U.S. Pat. No. 4,868,600, the disclosure of which is hereby incorporated by reference in its entirety.

Figure 3:
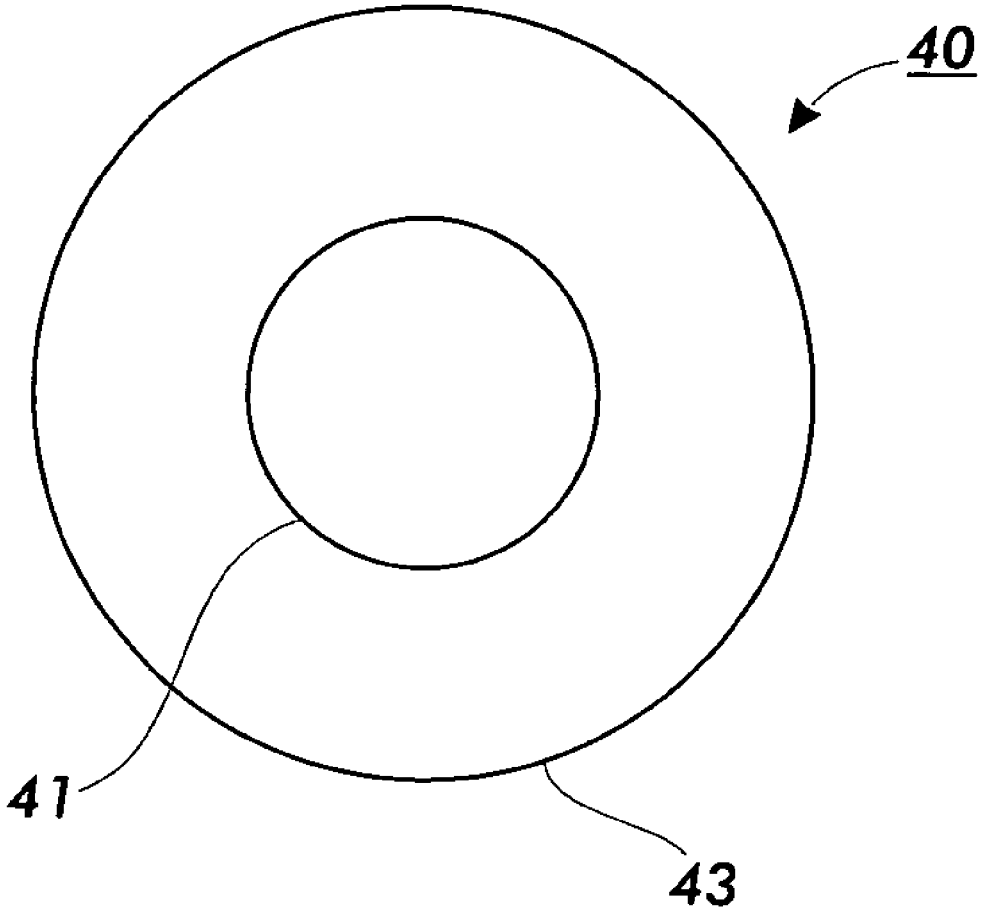
FIG. 3 is an enlarged illustration of a donor roll.

The donor member of the present invention may be in the form of a donor roller 40 as depicted in FIGS. 2 and 3, or in another known configuration. As shown in FIG. 3, the donor member 40 includes a substrate 41 which may comprise metal substrates such as, for example, copper, aluminum, nickel, and the like metals, plastics such as, for example, polyesters, polyimides, polyamides, and the like, glass and like substrates, which may be optionally coated with thin metal films, and a coating 43 including a blend of ceramic and metal.

Examples of suitable ceramics include alumina including, for example, pure alumina, chromium oxide, silicon nitride, silicone carbide, zirconium, and the like ceramics, and mixtures thereof.

Examples of suitable metals include molybdenum, tungsten, tantalum, and the like metals, and mixtures thereof.

The metal is present in the outer blended coating in an amount of from about 1 to about 20 weight percent with respect to the total weight of metal and other solids in the outer layer, or from about 10 to about 12 weight percent by weight of total solids. The ceramic is present in the outer blended coating in an amount of from about 80 to about 99 percent by weight of total solids, or from about 90 to about 92 percent by weight of total solids.

In an embodiment, the outer donor member layer 43 comprises a blend of molybdenum and alumina.

In embodiments, the outer donor member coating 43 has a resistivity of from about 103 to about 1010, or from about 106 to about 109 ohms-cm, or about 108 ohms-cm.

In embodiments, the outer donor member coating has a resistivity of from about $10^3$ to about $10^{10}$, or from about $10^6$ to about $10^9$ ohms-cm, or about $10^8$ ohms-cm.

The blended outer coatings herein are formed by known methods including alumina powder and molybdenum powder provided by Saint Gobain of Northhampton, Mass. These materials can be blended to the appropriate weight percent using a standard v-blender. The blended powder may then be coated onto a donor member using known methods such as spraying, dipping, roll coating, flow coating, extrusion, and the like. In embodiments, the outer layer is plasma spray coated onto a donor member substrate, or over a coating on a donor member substrate.

The blended outer coating on the donor member substrate is coated to a thickness of from about 200 to about 400 microns, or from about 250 to about 300 microns.

In an embodiment of the invention, an additional outer protective coating may be present on the blended layer coating described above. The outer protective layer may comprise inorganic or organic materials with coating thicknesses in the range of from about 10 nm to about 10 micron, or from about 0.5 to about 5 micron. The inorganic coatings may comprise polysilicates derived from a sol-gel process and diamond-like nanocomposites derived from plasma deposition, and mixtures thereof. The organic coatings may comprise soluble polymers or cross-linked polymers. Soluble polymers include but not limited to polycarbonates, polyimides, polyamides, polyesters, polysiloxanes, polyesters and mixtures thereof. Crosslinked polymers can be selected from but not limited to thermal or radiation curable vinyl or epoxy monomers, oligomers and polymers, unsaturated polyesters, polyamides, carbazole containing polymers, thiophene containing polymers, bistriarylamine containing polymers, and mixtures thereof. The organic coatings may contain additives in the range of from about 0.1 to about 50 percent by weight of the protective coatings. The additives include, but are not limited to, charge transport molecules and oxidants, the oxidized charge transport molecule salts, and particulate fillers such as silica, polytetrafluoroethylene or TEFLON® powder, carbon fibers, carbon black, and mixtures thereof. In embodiments, an outer protective coating may not be used.

The blended coating may be coated onto a donor member including a donor roller, belt, or applied over electrode donor members such as electrode wires. The outer coating may be ground using a diamond wheel to a desired surface finish and thickness.

All the patents and applications referred to herein are hereby specifically, and totally incorporated herein by reference in their entirety in the instant specification.

The following examples further define and describe embodiments of the present invention. Unless otherwise indicated, all parts and percentages are by weight.

EXAMPLES

Example 1

Preparation of Roller Substrate

A suitable roller substrate or core can be gritblasted to a suitable surface finish.

Example 2

Preparation of Bond Coat

It is possible to use a bond coat to enhance adhesion of the coating to the roller or sleeve. A chrome aluminum yttrium cobalt powder, commercially available from Praxair as CO-106-1, can be plasma sprayed over a grit blasted steel substrate according to manufacturer recommended spray parameters accompanying the powder. This would be followed by an optional plasma spray midcoat consisting of a 1:1 by volume mixture of chrome aluminum yttrium cobalt powder and titanium dioxide commercially available from Sulzer Metco as 102. Other commercially available bond coats are believed to be useful for either or both bond or mid-coating.

Example 3

Blended Ceramic/Metal Coating

Plasma spray coating of a blended alumina/molybdenum layer was accomplished with Praxair Thermal Spray Equipment using a SG 100 torch. The powder was obtained from Saint Gobain of Northhampton, Mass., and mechanically blended to specific weight ratios. The coating was sprayed to between 250 and 400 microns thickness. Alternative plasma coating approaches can use other equipment, gases, and/or powder particle sizes, wherein parameters are adjusted accordingly to achieve the same or similar result. For example, High Velocity Oxy Fuel (HVOF) or other thermal spray processes are believed to be adaptable and satisfactory to achieving comparable and equivalent coating results.

Example 4

Grinding of Blended Alumina/Molybdenum Outer Coating

The coating can be ground to between 150 and 200 microns thickness to achieve a desired diameter and surface finish.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. A donor member comprising a substrate and thereover a coating comprising ceramic and metal, wherein said ceramic is present in said coating in an amount from about 80 to about 99 percent by weight of total solids.

2. A donor member in accordance with claim 1, wherein said ceramic is selected from the group consisting of alumina, chromium oxide, silicon nitride, silicone carbide, zirconium, and mixtures thereof.

3. A donor member in accordance with claim 2, wherein said ceramic is alumina.

4. A donor member in accordance with claim 1, wherein said ceramic is present in said coating in an amount of from about 90 to about 92 percent by weight of total solids.

5. A donor member in accordance with claim 1, wherein said metal is selected from the group consisting of molybdenum, tungsten, tantalum, and mixtures thereof.

6. A donor member in accordance with claim 5, wherein said metal is molybdenum.

7. A donor member in accordance with claim 1, wherein said metal is present in said coating in an amount of from about 1 to about 20 percent by weight of total solids.

8. A donor member in accordance with claim 7, wherein said metal is present in said coating in an amount of from about 10 to about 12 percent by weight of total solids.

9. A donor member in accordance with claim 1, wherein said ceramic is alumina and said metal is molybdenum.

10. A donor member in accordance with claim 1, wherein said coating has a resistivity of from about $10^3$ to about $10^9$ ohms-cm.

11. A donor member in accordance with claim 10, wherein said coating has a resistivity of from about $10^6$ to about $10^9$ ohms-cm.

12. A donor member in accordance with claim 11, wherein said coating has a resistivity of about $10^8$ ohms-cm.

13. A donor member in accordance with claim 1, wherein said coating is coated on said substrate by a thermal spray process.

14. A donor member in accordance with claim 1, wherein said substrate is in the form of a cylindrical roll.

15. A donor member in accordance with claim 1, wherein said coating has a thickness of from about 200 to about 400 microns.

16. A donor member in accordance with claim 1, further comprising an outer protective layer positioned on said coating.

17. A donor member in accordance with claim 16, wherein said outer protective layer comprises a material selected from the group consisting of polysilicates, polycarbonates, polyimides, polyamides, polyesters, polysiloxanes, polyesters and mixtures thereof.

18. An apparatus for developing a latent image recorded on a surface, comprising:

a) a donor member spaced from the surface and being adapted to transport toner to a region opposed from the surface, wherein said donor member comprises a substrate and thereover a coating comprising ceramic and metal, wherein said ceramic is present in said coating in an amount of from about 80 to about 99 percent by weight of total solids; and b) an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image.

19. An image forming apparatus for forming images on a recording medium comprising:

a) a charge-retentive surface to receive an electrostatic latent image thereon;

b) a development component to apply toner to said charge-retentive surface to develop said electrostatic latent image to form a developed image on said charge retentive surface, said development component comprising a donor member comprising a substrate and thereover a coating comprising ceramic and metal, wherein said ceramic is present in said coating in an amount of from about 80 to about 99 percent by weight of total solids; and c) a transfer component to transfer the developed image from said charge retentive surface to a copy substrate.

* * * * *